United States Patent [19]

Moore

[11] Patent Number: 4,751,815

[45] Date of Patent: Jun. 21, 1988

[54] LIQUID FUEL SPRAYBAR

[75] Inventor: George W. Moore, Palm Beach Gardens, Fla.

[73] Assignee: United Technologies Corporation, Hartford, Conn.

[21] Appl. No.: 902,263

[22] Filed: Aug. 29, 1986

[51] Int. Cl.[4] ..... F02K 3/10; F02C 7/08

[52] U.S. Cl. ..... 60/261; 60/749; 60/738

[58] Field of Search ..... 60/261, 738, 264, 737, 60/749, 241, 243

[56] References Cited

U.S. PATENT DOCUMENTS

| | | | |
|---|---|---|---|
| 1,415,781 | 5/1922 | Bouen | 60/738 |
| 2,705,868 | 4/1955 | Forman | 60/261 |
| 2,799,991 | 7/1957 | Conrad | 60/261 |
| 2,861,424 | 11/1958 | Jurisich | 60/749 |
| 2,920,445 | 1/1960 | Bailey | 60/261 |
| 2,944,388 | 7/1960 | Bayer | 60/261 |
| 3,698,186 | 10/1972 | Beane et al. | 60/261 |
| 3,719,042 | 3/1973 | Chamberlain | 60/261 |
| 3,899,883 | 8/1975 | Stakie et al. | 60/261 |
| 3,938,325 | 2/1976 | Bergt | 60/261 |
| 4,541,239 | 9/1985 | Tokura | 60/738 |

FOREIGN PATENT DOCUMENTS

| | | | |
|---|---|---|---|
| 2232228 | 1/1973 | Fed. Rep. of Germany | 60/261 |
| 650608 | 2/1951 | United Kingdom | 60/738 |

*Primary Examiner*—Louis J. Casaregola
*Assistant Examiner*—Timothy S. Thorpe
*Attorney, Agent, or Firm*—Troxell K. Snyder

[57] ABSTRACT

A fuel spraybar (16) having an elongated, closed housing (26) discharges fuel from a plurality of openings (32) into an exhaust gas stream (12). A first fuel conduit (34) conducts liquid fuel through the housing (26) and into an annular volume (38) formed therebetween. The fuel, heated by contact with the housing (26) is vaporized in the annulus (38) for preferentially discharging liquid fuel (18) in an axial pilot zone (40) within the gas stream (12).

2 Claims, 2 Drawing Sheets

LIQUID FUEL SPRAYBAR

The United States Government has rights in the subject matter of this invention.

FIELD OF THE INVENTION

The present invention relates to a spraybar for distributing a flow of liquid fuel in a flowing gas stream.

BACKGROUND

The proper distribution of liquid fuel in a flowing gas stream is the objective of a wide variety of fuel combusting processes and equipment. One particularly demanding application is in a thrust augmentor for establishing afterburning in the exhaust gas stream of a gas turbine engine.

As the state of the gas turbine art has advanced, the temperature of the exhaust gases exiting the engine have climbed. Higher exhaust gas temperatures have required designers to seek ways to avoid vaporization of the liquid fuel within the augmentor fuel distribution structure disposed in the high temperature exhaust environment. As will be appreciated by those skilled in the art, the two phase flow created by the partial vaporization of a liquid can radically distort the mass flow pattern within a closed conduit or other liquid distribution system.

One prior art solution has been to surround the fuel distributor with an air cooled shield supplied by relatively cool air diverted from the upstream portion of the gas turbine engine. As with the exhaust gas stream, the temperature of this diverted air increases with increasing engine performance, reaching, in certain applications, temperatures at which the "relatively cool" air is too warm to prevent vaporization of the augmentor fuel. Another strategy has been to specify less volatile augmentor fuel for use in such high temperature engines and applications, thus allowing the liquid fuel temperature to be raised an additional amount before the onset of vaporization.

The fuel vaporization problem is especially critical at the initiation of augmentor operation when the augmentor is supplied with a relatively low fuel flow rate in order to avoid a high pressure transient upon ignition. Prior art fuel distributors have been subject to such pressure spikes and other instabilities in the augmentor light off due to flow irregularities caused by the vaporization of the fuel as it first enters the heated distribution structure. Irregular flow continues for that time period during which the augmentor fuel flow is slowly increased to a minimum continuous flow at which the fuel is discharged into the gas stream before absorbing enough heat to vaporize.

As will be appreciated by those skilled in the art, the occurrence of a vapor bubble or two phase mixture in a prior art spraybar may cause the bar to unevenly discharge fuel into the gas stream, possibly causing a wide variation in local fuel to air ratios. Typical augmentor arrangements use one or more igniters disposed in a pilot region near the gas flow centerline within the augmentor for encouraging smooth, reduced pressure transient light off and continued stable augmentor combustion. What is needed is a spraybar which can ensure a proper flow of fuel to this igniter equipped pilot region at initial and relatively low fuel mass flow rates.

SUMMARY OF THE INVENTION

It is therefore an object of the present invention to provide a spraybar for distributing a flow of volatile liquid fuel in a gas stream.

It is further an object of the present invention to provide a spraybar wherein the vaporization of the liquid fuel is controlled to avoid improper distribution of fuel in the gas stream at relatively low fuel flow rates.

It is still further an object of the present invention to provide a spraybar able to deliver an optimum fuel distribution to a particular region of the gas flow stream regardless of its orientation with respect to gravitational or other forces.

According to the present invention, a fuel spraybar is provided with an outer, elongated housing disposed in the gas stream. An inner fuel conduit carries the liquid fuel through the length of the housing, discharging the fuel into the housing interior adjacent a first closed end. The fresh fuel fills the end of the housing interior and flows back along the outside of the fuel conduit through a annular volume formed between the conduit and the housing. Fuel exits the interior through a plurality of discharge openings distributed along the length of the housing.

At relatively low or initial fuel flow, the liquid fuel leaving the fuel conduit fills the interior of the first end of the housing and begins to flow back through the annular volume. Relatively hot gas contacting the exterior of the housing warms the liquid fuel, causing it to partially evaporate. Due to the continuing supply of fresh fuel adjacent the first end of the housing, the spraybar according to the present invention restricts fuel vaporization to the annular volume of the spraybar, thus avoiding any disruption of the discharge of liquid fuel from the fuel discharge openings located near the first end of the housing.

This controlled fuel vaporization is particularly beneficial in a gas turbine engine thrust augmentor wherein one or more fuel spraybars distribute the liquid fuel over a relatively hot gas stream. By locating the first end of the spraybar within the pilot region of the augmentor, the present invention ensures the proper local fuel/air ratio necessary to light off the augmentor and quickly stabilize the flame at relatively low fuel delivery rates.

Further, by properly sizing the relative dimensions of the housing and fuel conduit, the spraybar according to the present invention may be made functional at any orientation within the thrust augmentor. An alternative embodiment of the present invention provides two distinct radial firing zones when the spraybar is oriented radially with respect to the augmentor flow, the radially inner spraybar zone having the controlled vaporization feature discussed above.

It will be apparent to those skilled in the art that both these and other objects and advantages may be realized without departing from the scope of the present invention as more specifically described, claimed, and illustrated herein.

DETAILED DESCRIPTION OF THE PREFERRED EMBODIMENT

Figure 1:
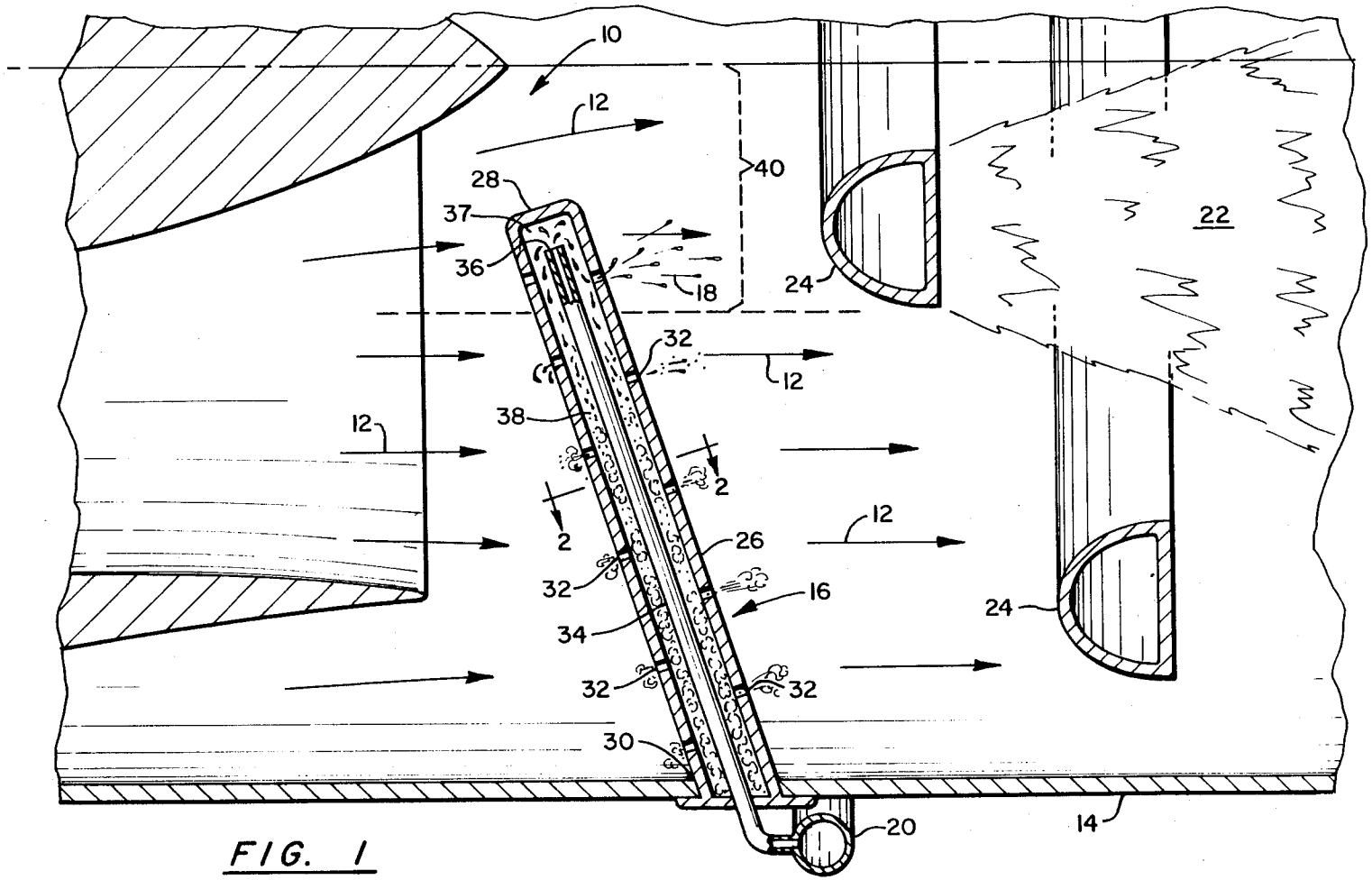
FIG. 1 shows a cross sectional view of a gas turbine engine exhaust and thrust augmentor including a fuel spraybar according to the present invention.

Referring now to FIG. 1, an axial cross section of a gas turbine engine exhaust 10 is shown having a stream of exhaust gases 12 exiting therefrom and flowing downstream within a cylindrical augmentor casing 14. A spraybar 16 is shown disposed in the exhaust gas flow 12 for discharging liquid fuel 18 supplied from a manifold 20. The discharged fuel 18 mixes with the exhaust gases 12 and is reacted in a downstream combustion region 22 established by one or more flameholder structures 24.

The spraybar 16 according to the present invention includes an elongated, outer housing 26 extending substantially radially inward from the augmentor case 14 and having a first, closed end 28 and a second end 30 secured to the case 14. The outer housing 26 includes a plurality of fuel discharge openings 32 disposed therein for discharging liquid fuel supplied to the interior of the housing 26 by an internal fuel supply conduit 34. The internal conduit 34 runs substantially the entire length of the housing 26, extending from the housing second end 30, terminating 36 at a point spaced apart from the housing first end 28.

Liquid fuel flows through conduit 34 and is exhausted therefrom into a fuel receiving volume 37 adjacent the first housing end 28, flowing back over the conduit 34 through the contiguous annular volume 38 cooperatively defined by the fuel conduit 34 and the housing 26, and exiting via the fuel discharge openings 32.

The first end 28 of the housing 26 is disposed within a pilot region 40 encompassing a radially inner portion of the exhaust gas flow 12. The pilot region 40 is so designated as it includes the central, initial light off zone for the augmentor combustion reaction and is typically therefore equipped with one or more combustion igniters (not shown) for initiating the augmentor combustion reaction.

During initial light off of the thrust augmentor at high exhaust gas temperatures, fuel is supplied to the spraybar 26 from the fuel manifold 20 at a relatively low delivery rate. The fuel flows through the conduit 34 and is discharged adjacent the first housing end 28. The fresh fuel entering the first end 28 of the housing maintains a local fuel temperature below the vaporization point, but absorbs heat energy and increases in temperature as it flows back through the annular volume 38.

As is illustrated in FIG. 1, the fuel in the annular volume begins to vaporize, resulting in a two phase mixture of increasing vapor fraction with increasing radial displacement. The vapor bubbles and two phase mixture present in the annular volume restrict the mass flow of fuel to the discharge openings 32 disposed therein, resulting in the greatest fraction of the fuel mass delivered from the conduit 34 being discharged as a liquid from the discharge openings 32 located near the first end 28 of the housing 26. The liquid fuel thus discharged in the pilot region 40 of the exhaust gas flow 12 provides a sufficiently high local fuel to air ratio to achieve reliable augmentor light off and flame stability in the pilot region.

It will be appreciated by those skilled in the art of two phase fluid flow, that the cross sectional area of the annular area volume 38 must be sufficiently small so as to prevent the liquid fuel from freely flowing down to the second end 30 of the housing 26 when the spraybar is oriented as shown in FIG. 1. Such a dimension is related to the relative amount of vaporized fuel present in the volume 38, the overall fuel mass flow rate at the particular point along the length of the annular volume 38, and the fluid flow characteristics and interaction of the vapor and liquid states of the fuel. It has been demonstrated experimentally that an annular volume having a transverse cross sectional area no greater than the cross sectional flow area of the inner conduit 34 allows the spraybar 16 according to the present invention to function as described above at any orientation with respect to gravitational forces.

Figure 2:
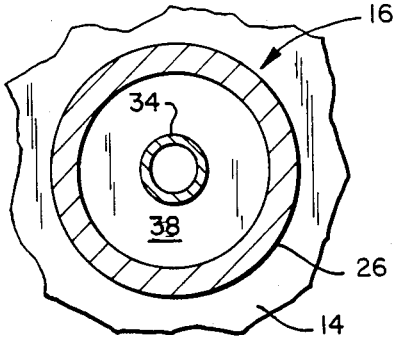
FIG. 2 shows a cross sectional view of the spraybar as indicated in FIG. 1.

FIG. 2 shows the indicated cross section of the spraybar 16 of the preferred embodiment wherein the housing 26 and fuel conduit 34 are cylindrical and disposed coaxially with respect to each other. A cylindrical shape provides an excellent compromise with regard to strength, simplicity, and cost, however nearly any shape housing 26 or fuel conduit 34 may be used which define an annular volume 38 therebetween. Thus, the present invention specifically includes oval, asymmetric, airfoil, or any of a variety of other cross sectional configurations which may be found beneficial for conducting and discharging liquid fuel into a flowing gas stream.

As the rate of fuel delivery to the spraybar 16 increases, the average temperature of the fuel within the housing 26 will be reduced as the fuel stays less time within the housing 26 prior to discharge. It is intended that the partially vaporized state shown in FIG. 1 be present within the spraybar 16 according to the present invention for only so long as is necessary to ramp up the fuel delivery rate to a minimum flow at which no vapor is present within the housing 26.

Figure 3:
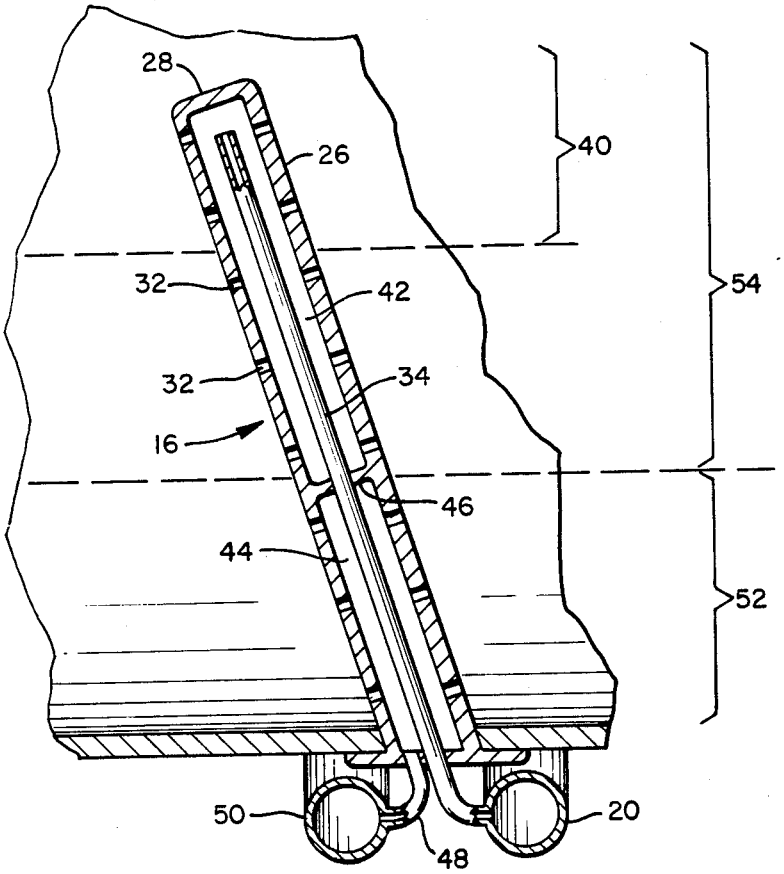
FIG. 3 shows a longitudinal cross sectional view of an alternative embodiment spraybar providing two distinct firing zones.

FIG. 3 shows an alternative, two zone spraybar according to the present invention wherein the first end 28 of the housing 26 is disposed in the pilot zone 40, and the annular volume defined by the housing 26 and the fuel conduit 34 is divided between a first, inner annular volume 42 and a second, outer annular volume 44 by an internal fluid tight barrier 46.

The inner annular volume 42 receives fuel from the first fuel conduit 34 and functions exactly as does the FIG. 1 embodiment, preferentially vaporizing the supplied fuel at low or initial delivery rates within the annular volume 42. The outer annular volume 44 receives fuel from a second fuel conduit 48 supplied by a separate, second fuel manifold 50 as shown. The spraybar 16 thus is able to independently supply fuel from the manifold 50 to an outer augmentor zone 52, while the fuel delivered from the first manifold 20 is distributed over an inner zone 54 which includes the pilot region 40. Such multiple zone systems are common in thrust augmentor arrangements wherein it is desired to stage a varying flow of augmentor fuel over two or more separate augmentor flow area zones.

The outer annular volume 44 and fuel supply means 48, 50 do not provide the controlled vaporization of the FIG. 1 embodiment or of the first annular volume 42 of the FIG. 3 embodiment, however the outer augmentor zone 52 is typically utilized only after full firing has been established in the inner augmentor zone 54, thus eliminating the likelihood of flame instability or other undesirable operation.

It will further be appreciated by those skilled in the art that the flow of fuel within the first fuel conduit 34 in both the FIG. 1 and FIG. 3 embodiments of the spraybar 18 according to the present invention is well protected from the surrounding high temperature exhaust gas stream 12 by the housing 26 and the annular volumes 38, 42, 44 defined therewithin. This double wall or tube-within-a-tube arrangement prevents the occurrence of rapid heat absorption by the fresh fuel. The presence of vaporizing fuel in the annular volume 38 of FIG. 1 or 42 of FIG. 3 provides further protection by utilizing any heat transmitted by the housing 26 for vaporizing the liquid fuel in the annular volume.

It will also be appreciated that the spraybar according to the present invention is equally functional disposed within a surrounding shroud or fairing (not shown) for providing additional thermal protection for the fuel by conducting a flow of relatively cool air over the outer surface of the housing 26. In such an arrangement the fuel discharge openings 32 would correspond positionally with holes or discharge ports in the shroud for passing the discharged fuel 18 into the exhaust gas stream 12.

It is thus apparent that the spraybar 16 according to the present invention is well adapted to achieve the objects and advantages as set forth hereinabove and as may further become apparent to those skilled in the art. It should further be appreciated that the invention may take various forms other than those embodiments described herein and that the foregoing description and appended drawing figures should therefore be interpreted in an illustrative and not a limiting sense.

I claim:

1. A plurality of radial spraybars for distributing a varying flow of volatile liquid fuel over a stream of relatively hot oxidizing gas flowing in a cylindrical thrust augmentor, the gas having a temperature above the liquid fuel vaporization temperature, comprising:

means for discharging the liquid fuel only in a coaxially central pilot region of the gas stream, including an elongated, heat conducting housing extending radially across the hot gas stream and having a plurality of fuel discharge openings therein, the housing having a first, radially inward closed end located within the pilot region and a second, radially outward end, a first fuel conduit disposed coaxially within the housing for conducting the flow of liquid fuel longitudinally through the housing from the second end thereof and discharging the conducted fuel adjacent the housing first end into an annular volume defined between the first fuel conduit and the housing, wherein the first fuel conduit and the annular volume each further define a cross-sectional flow area measured transversely with respect to the elongated housing, and wherein the annular cross-sectional flow area is no greater than the first fuel conduit cross-sectional flow area.

2. The spraybar as recited in claim 1, wherein the annular volume is divided longitudinally by a transverse barrier into an inner annular volume and an outer annular volume, each respectively disposed adjacent the first and second ends of the housing, and wherein the flow of liquid fuel is selectably split between a first portion conducted to the inner annular volume by the first fuel conduit and a second portion conducted to the outer annular volume by a second fuel conduit.

* * * * *